United States Patent [19]

Clements

[11] 4,337,164

[45] Jun. 29, 1982

[54] BLEACH COMPOSITION

[75] Inventor: Anthony H. Clements, Cefn y Bedd, Wales

[73] Assignee: Lever Brothers Company, New York, N.Y.

[21] Appl. No.: 237,793

[22] Filed: Feb. 24, 1981

Related U.S. Application Data

[63] Continuation-in-part of Ser. No. 176,750, Aug. 11, 1980, abandoned.

[30] Foreign Application Priority Data

Aug. 16, 1979 [GB] United Kingdom ..... 7928590

[51] Int. Cl.[3] ..... C11D 9/42

[52] U.S. Cl. ..... 252/96; 252/95; 252/99; 252/103; 252/186.42; 8/111; 252/174.12; 252/DIG. 12

[58] Field of Search ..... 252/95, 96, 99, 103, 252/186, 174.12; 8/111

[56] References Cited

U.S. PATENT DOCUMENTS 3,822,114 7/1974 Montgomery ..... 252/95 X

*Primary Examiner*—Mayer Weinblatt

[57] ABSTRACT

A low temperature bleach system comprises an organic peracid and bromide ions in the absence of aldehydes and ketones. The bromide ions may be supplied from sodium bromide and typical peracids include diperisophthalic acid and monoperoxyphthalic acid. The peracid to bromide equivalent ration between 2:1 and 1:2 is preferred, but dye transfer and hygiene benefits are possible with a ratio up to 1:50. The system may be used as such or incorporated in a conventional detergent base.

6 Claims, No Drawings

BLEACH COMPOSITION

This is a continuation of application Ser. No. 176,750, filed Aug. 11, 1980, now abandoned.

TECHNICAL FIELD

This invention relates to a bleach system, particularly for fabrics, which is effective at low temperatures. The invention also relates to fabric washing compositions comprising said bleach system which can be used for washing at high temperatures as well as at low temperatures. By the term "low temperatures", temperatures ≦40° C. are meant here.

With increasing trend of saving energy, housewives are becoming more and more energy-conscious and have gradually changed their washing habit towards lower wash-temperatures.

BACKGROUND ART

Inorganic persalts giving hydrogen peroxide in solution, such as sodium perborate, are widely used as a bleaching agent in detergent compositions. These persalts provide a satisfactory bleach when the detergent composition is used at high temperatures, e.g. 80°–100° C., but their action is rather slow to substantially nil at lower wash-temperatures.

It is known that organic peracids, e.g. peracetic acid, are active at lower temperatures and the use of peracids in detergent compositions, either as such or formed in situ, has been suggested to give the detergent composition satisfactory bleaching properties at lower wash-temperatures, e.g. in the 60° C. wash-cycle.

A considerable saving of energy would be obtained if washing habits could be further shifted towards cold and cool water washing, e.g. below 40° C., also for whites.

Unfortunately, however, organic peracids do not exhibit adequate bleaching at these low temperatures.

It is an object of the present invention to provide an improved bleach system which is also effective at temperatures below 40° C.

Another object of the present invention is to provide a bleach composition suitable for use in cold and cool water washing at temperatures below 40° C.

British Patent Specification No. 1,368,400 describes the activation of organic peracids by means of rather complex aldehyde or ketone compounds as the bleach activator. The use of a chloride salt (in fabric bleaching) and of a chloride or bromide salt (in hard surface bleaching) is described only in conjunction with said activated peracid system.

DISCLOSURE OF THE INVENTION

It has now been found surprisingly that the bleaching action of organic peracids can be enhanced to enable bleaching of fabrics at low temperatures, without the use of such aldehyde or ketone activators, merely by the addition of bromide ions in the absence or substantial absence of aldehydes, ketones or compounds which yield aldehydes or ketones in aqueous solution. Although the exact mode of action of this specific bromide catalysis is not fully understood, it is believed that, despite the absence of activators, bromides, unlike chlorides, react sufficiently rapidly with peracids to form effective amounts of hypobromite. The hypobromite formed is a far superior bleach to peracids and is more effective at low temperatures.

As the reaction of bromides with peracids probably involves a nucleophilic attack of bromide ion on the electrophilic peroxidic oxygen, the rate of reaction will depend on the concentration and reactivities of the bromide and peracid. Though theoretically an equimolar amount of bromide would be necessary for complete conversion of bromide to hypobromite, it was found that, surprisingly, a significant improvement of the bleaching effect at low temperatures can already be achieved with less than said theoretical equimolar amount of bromide. An explanation thereof may be that on reaction with certain components of the wash system (including soil components) hypobromites reform the parent bromide ion according to the following reaction equation:

$$OBr^{\ominus} + \text{wash component} \rightarrow \text{oxidised wash component} + Br^{\ominus}$$

According to the invention there is provided a bleach composition comprising an organic peracid and an organic or inorganic material which delivers bromide ions in aqueous media, the molar equivalent ratio of said organic peracid to said material which delivers bromide ions being not more than about 5:1, in the absence of, or in the substantial absence of, aldehydes, ketones and materials which yield aldehydes or ketones in aqueous solution.

The term "substantial absence" used above means that there is present less than one weight part of aldehyde, ketone or material that yields aldehydes or ketones in solution per 100 weight parts of organic peracid. The presence of aldehydes and ketones have sometimes been found to have a negative effect on organic peracid/bromide systems and preferably they should not be present at all.

This negative effect is thought to be due to an interaction between, for example, the ketone and the hypobromite formed in solution.

Best Mode of carrying out the invention

For best bleaching results it is preferred that one molar equivalent ratio of the peracid to the bromide-delivering material lies between about 5:1 and about 1:3, most preferably between about 2:1 and about 1:2. However advantageous effects, particularly hygiene effects, can also be achieved where the peracid is present in a relatively minor amount, i.e. where the above ratio lies between 1:3 and about 1:50.

It may be necessary to use said higher proportions in case halogenation of the soil occurs, which consumes bromide ions. The organic or inorganic material which delivers bromide ions in aqueous media is preferably a water soluble bromide salt. Alternatively an ion exchange resin which delivers bromide ions in aqueous media can be used.

The organic peracids which can be used in the present invention are known in the art. They can be either aliphatic or aromatic and have the general formula:

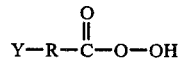

wherein R is an alkylene group containing from 1–16 carbon atoms or an arylene group containing from 6–8 carbon atoms and Y is hydrogen, halogen, alkyl, aryl or any group which provides an anionic moiety in aqueous solution, for example

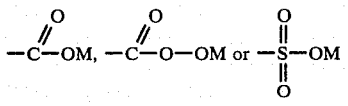

wherein M is hydrogen or a water soluble salt-forming cation.

Examples of aliphatic peracids are peracetic acid, mono perazelaic acid, diperazelaic acid and diperadipic acid. Diperazelaic acid is particularly preferred.

Examples of aromatic peracids are monoperphthalic acid, perbenzoic acid, m-chloro-perbenzoic acid, diperisophthalic acid or mixtures thereof.

The bleach system of the present invention can be used as such or it can be used in conjunction with a detergent product for washing and bleaching fabrics. It can be suitably used in relatively short washes as well as in relatively longer soak-washings under room temperature conditions up to 40° C., or at higher temperatures, with much less risk of discolouring dyed fabrics than common commercial chlorine bleaches, e.g. sodium hypochlorite or potassium dichloroisocyanurate. It is, moreover, less aggressive to fabrics than chlorine bleaches. A further advantage of of the invention is that staining of white fabrics by dye transfer is inhibited.

The bleach system of the invention can be either employed as part of a complete detergent bleach composition comprising any of the usual detergent ingredients or as a separate bleach additive for use in bowl washing or in fabric washing machines. It may be presented in the form of either a powder or granules, a water-soluble or water-permeable unit package, or a tablet.

Hence, the bleach composition of the present invention may comprise:

1. from 0.1 to 40 parts, preferably 0.5–35 parts by weight of an organic peracid; and 2. from 0.1 to 40 parts, preferably 0.5–35 parts by weight of a water soluble bromide salt; optionally together with:

3. from 0 to 40 parts, preferably 5–35 parts by weight, of a water-soluble organic detergent selected from the group consisting of organic synthetic anionic detergents, nonionic detergents, alkalimetal soaps (e.g. of $C_8$–$C_{22}$ fatty acids), or mixtures thereof;

4. from 0 to 80 parts, preferably 10–60 parts by weight, of a water-soluble builder salt;

5. from 0 to 30 parts, preferably 0–25 parts by weight of fillers; and 6. from 0 to 30, preferably 0.2–20 parts by weight of other suitable adjuncts and ingredients, such as for example N-H compounds such as urea, optical brighteners, soil-suspending agents, dyestuffs, perfumes, enzymes, including proteolytic and amylolytic enzymes and catalase, moisture and mixtures thereof.

Typical synthetic anionic detergents are the alkyl benzene sulphonates having from 8–16 carbon atoms in the alkyl group, e.g. sodium dodecyl benzene sulphonate; the aliphatic sulphonates, e.g. $C_8$–$C_{18}$ alkane sulphonates; the olefin sulphonates having from 10–20 carbon atoms, obtained by reacting an alpha-olefin with gaseous diluted sulphur trioxide and hydrolysing the resulting product; the alkyl sulphates such as tallow alcohol sulphate; and further the sulphation products of ethoxylated and/or propoxylated fatty alcohols, alkyl phenols with 8–15 carbon atoms in the alkyl group, and fatty acid amines, having 1–8 moles of ethoxylene or propoxylene groups.

Typical nonionic detergents are the condensation products of alkyl phenols having 5–15 carbon atoms in the alkyl group with ethylene oxide, e.g. the reaction product of nonyl phenol with 6–30 ethylene oxide units; the condensation products of higher fatty alcohols, such as tridecyl alcohol and secondary $C_{10}$–$C_{15}$ alcohols, with ethylene oxide, known under the trade name of "Tergitols" ® supplied by Union Carbide; the condensation products of fatty acid amide with 8–15 ethylene oxide units and the condensation products of polypropylene glycol with ethylene oxide.

Suitable builders are weakly acid, neutral or alkaline reacting, inorganic or organic compounds, especially inorganic or organic complex-forming substances, e.g. the bicarbonates, carbonates, borates or silicates of the alkalimetals; the alkalimetal ortho-, meta-, pyro- and tripolyphosphates. Another class of suitable builders are the insoluble sodium aluminosilicates as described in Belgian Patent Specification No. 814,874.

Usual fillers are the alkalimetal sulphates, especially sodium sulphate.

A major advantage of the bleach composition of the invention is that it can be used as an energy-saving product in cold and cool water washing of white fabrics with good results.

Bleach compositions according to the invention may be formed by a variety of methods such as dry mixing the components of the composition in any desired order.

EXAMPLE 1

Washing experiments were carried out with a detergent base powder of the following composition:

| Base Powder Composition | % by Weight |
|---|---|
| sodium $C_{12}$-alkyl benzene sulphonate | 18 |
| coconut fatty acid ethanol amide | 2.5 |
| sodium triphosphate | 38 |
| sodium silicate | 9 |
| sodium sulphate | 21 |
| sodium carboxymethylcellulose | 0.4 |
| ethylene diamine-tetraacetate | 0.15 |
| water + salts | up to 100% |

A fixed amount of diperisophthalic acid was added to the wash solution at each washing; sodium bromide was added in varying amounts.

Washes were carried out isothermally in mechanically stirred glass beakers loaded with tea-stained test swatches. Ingredients were added as quickly as possible in the following order: base powder, bleach, bromide.

| Washing conditions: | |
|---|---|
| Diperisophthalic acid (DPIPA) | $0.355 \times 10^{-3}$ M/liter |
| Base powder | 0.4% by weight |
| Sodium bromide | $0.71 \times 10^{-3}$ M/liter |
| Temperature | 40° C. |
| Duration of wash | 15 minutes |
| Tea-stained test swatches | |
| 18° H Water | |

The obtained bleaching results, measured by the increase in reflectance (ΔR 460) of swatches before and after washing, are set out in Table A.

The results in Table A also show the effect of pH on the bleach results of a bleach system comprising diperisophthalic acid and sodium bromide, the pH being adjusted by the addition of $H_2SO_4$ or NaOH.

In this example the molar equivalent ratio of the organic peracid (DPIPA) to the material which delivers bromide ions (NaBr) is 1:1.

TABLE A

| pH | Base powder | ΔR 460 base powder + DPIPA | Base powder + DPIPA + NaBr |
|---|---|---|---|
| 5 | 2.5 | 11.2 | 16.5 |
| 6 | 2.5 | 14.3 | 18.3 |
| 7 | 2.5 | 14.2 | 19.8 |
| 8 | 2.1 | 10.5 | 13.5 |
| 9 | 1.8 | 4.5 | 5.4 |
| 10 | 1.7 | 3.0 | 3.5 |
| 11 | 1.7 | 3.0 | 3.5 |

EXAMPLE IV

The following experiments demonstrate the effect of halide activated peracid bleach systems in reducing dye transfer. 30 minute washes were carried out on a nylon cloth dyed with C.I. disperse blue 16 together with a clean white non-fluorescent bulked nylon 6,6 dye transfer monitor. Dye transfer was indicated by the reflectance, at 675 nm, of the monitor at the end of the wash. The reflectance of the clean unwashed monitor was 89. Wash conditions (base powder, temperature, water hardness) were otherwise as stated for Example I. The results are set out in Table C.

The above Example IV shows that excellent dye transfer results can be obtained with a bleach system according to the invention.

TABLE C

| Peracid | Peracid Concentration g/l | Peracid Concentration moles/l | KBr Concentration g/l | KBr Concentration moles/l | Peracid:Bromide Equivalent Ratio | R675 |
|---|---|---|---|---|---|---|
| Base powder alone | — | — | — | — | — | 61.3 |
| Monoperoxyphthalic acid | 0.084 | $4.6 \times 10^{-4}$ | — | — | 1:0 | 63.0 |
| Monoperoxyphthalic acid | 0.084 | $4.6 \times 10^{-4}$ | 0.0547 | $4.6 \times 10^{-4}$ | 1:1 | 86.7 |
| Diperisophthalic acid | 0.045 | $2.3 \times 10^{-4}$ | — | — | 1:0 | 67.4 |
| Diperisophthalic acid | 0.045 | $2.3 \times 10^{-4}$ | 0.0547 | $4.6 \times 10^{-4}$ | 1:1 | 87.3 |
| Diperisophthalic acid | 0.018 | $9.2 \times 10^{-5}$ | — | — | 1:0 | 65.9 |
| Diperisophthalic acid | 0.018 | $9.2 \times 10^{-5}$ | 0.0109 | $9.2 \times 10^{-5}$ | 1:0.5 | 65.8 |
| Diperisophthalic acid | 0.018 | $9.2 \times 10^{-5}$ | 0.109 | $9.2 \times 10^{-4}$ | 1:5 | 67.1 |
| Diperisophthalic acid | 0.018 | $9.2 \times 10^{-5}$ | 0.327 | $2.76 \times 10^{-3}$ | 1:15 | 75.5 |
| Diperisophthalic acid | 0.018 | $9.2 \times 10^{-5}$ | 0.547 | $4.6 \times 10^{-3}$ | 1:25 | 81.5 |
| Diperisophthalic acid | 0.018 | $9.2 \times 10^{-5}$ | 1.09 | $9.2 \times 10^{-3}$ | 1:50 | 84.2 |

EXAMPLE II–III

Washing/bleaching experiments were carried out under soaking conditions at 25° C. as in Example I except that in one series the peracid was diperisophthalic acid used at a concentration of $0.355 \times 10^{-3}$ Moles/liter and in another series the peracid was peracetic acid, used in a concentration of $0.71 \times 10^{-3}$ Moles/liter. In both cases the peracid to bromide molar equivalent ratio was 1:1. Soaking was continued overnight.

The beaker contents were stirred for the first 4 hours and thereafter left to soak overnight. The results are shown in Table B.

TABLE B

| Time in hours | Base + DPIPA (pH-9.2) without NaBr | Base + DPIPA (pH-9.2) + NaBr | Base + peracetic acid (pH7 adjusted) without NaBr | Base + peracetic acid (pH7 adjusted) + NaBr |
|---|---|---|---|---|
| 1 | 5.2 | 5.5 | 7.2 | 7.6 |
| 2 | 7.2 | 8.6 | 10.4 | 14.6 |
| 3 | 8.7 | 11.8 | 12.5 | 17.4 |
| 4 | 10.7 | 14.0 | 14.4 | 22.6 |
| 20 | 18.8 | 20.4 | 25.0 | 27.0 |

The above Examples I–II show that excellent bleach results can be obtained with the bleach systems of the invention at a temperature of 25° C., ie. with hardly any energy consumption.

We claim:

1. A bleach composition consisting essentially of:

(a) 0.1–40 parts by weight of an organic peracid having the general formula:

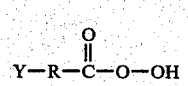

wherein R is an alkylene group containing from 1–16 carbon atoms or an arylene group containing from 6–8 carbon atoms and Y is selected from the group consisting of hydrogen, halogen, alkyl, aryl,

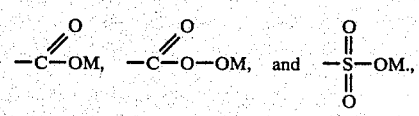

wherein M is hydrogen or a water soluble salt forming cation; and (b) 0.1–40 parts by weight of a water-soluble bromide salt which delivers bromide ions in aqueous media; the molar equivalent ratio of said organic peracid and said bromide salt being not more than 5:1, in the substantial absence of aldehydes, ketones and materials which yield aldehydes or ketones in aqueous solution.

2. A bleach composition according to claim 1, wherein said molar equivalent ratio is between about 1:3 and about 1:50.

3. A bleach composition according to claim 1, wherein said molar equivalent ratio is from about 5:1 and about 1:3.

4. A bleach composition according to claim 3, wherein said molar equivalent ratio is between about 2:1 and about 1:2.

5. A bleach composition according to claim 1, wherein the organic peracid is selected from the group consisting of monoperoxyphthalic acid, diperisophthalic acid, diperazelaic acid, and mixtures thereof.

6. A bleach composition consisting essentially of (a) 0.5–35 parts by weight of an organic peracid having the general formula

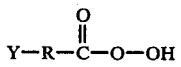

wherein R is an alkylene group containing from 1–16 carbon atoms or an arylene group containing from 6–8 carbon atoms and Y is selected from the group consisting of hydrogen, halogen, alkyl, aryl

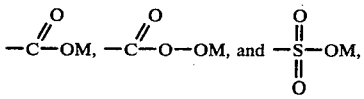

wherein M is hydrogen or a water soluble salt forming cation;

(b) 0.5–35 parts by weight of a water soluble bromide salt which delivers bromide ions in aqueous media;

(c) 5–35 parts by weight of a water soluble organic detergent selected from the group consisting of organic synthetic anionic sulphonate of sulphate detergents, nonionic detergents, alkalimetal soaps of $C_8$–$C_{22}$ fatty acids, and mixtures thereof, and (d) 10–60 parts by weight of a builder selected from the group consisting of weakly acid, neutral or alkaline reacting inorganic or organic compounds, inorganic or organic complex forming substances, aluminosilicates, and mixtures thereof, said composition being substantially free from aldehydes, ketones and materials which yield aldehydes or ketones in aqueous solution.

* * * * *